US006872352B2

(12) United States Patent
Hernandez et al.

(10) Patent No.: US 6,872,352 B2
(45) **Date of Patent: *Mar. 29, 2005**

(54) PROCESS OF MAKING WEB OR FIBERFILL FROM POLYTRIMETHYLENE TEREPHTHALATE STAPLE FIBERS

(75) Inventors: Ismael A. Hernandez, Clemmons, NC (US); Geoffrey David Hietpas, Newark, DE (US); James M. Howell, Greenville, NC (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 186 days.

This patent is subject to a terminal disclaimer.

(21) Appl. No.: 09/934,905

(22) Filed: Aug. 22, 2001

(65) Prior Publication Data

US 2002/0153641 A1 Oct. 24, 2002

Related U.S. Application Data

(60) Provisional application No. 60/231,852, filed on Sep. 12, 2000.

(51) Int. Cl.[7] ..... D01D 5/22; D01D 5/26; D01F 6/62; D02G 1/12; D04H 3/16

(52) U.S. Cl. ..... 264/442; 19/98; 19/145.7; 28/100; 28/263; 156/62.4; 156/73.2; 264/103; 264/143; 264/168; 264/171.1; 264/210.2; 264/210.7; 264/210.8; 264/211.14; 264/342 RE

(58) Field of Search ..... 264/103, 143, 264/168, 171.1, 210.2, 210.7, 210.8, 211.14, 342 RE, 442; 156/62.4, 73.2; 19/98, 145.7; 28/100, 263

(56) References Cited

U.S. PATENT DOCUMENTS

| | | | |
|---|---|---|---|
| 2,465,319 | A | 3/1949 | Whinfield et al. |
| 3,038,237 | A | 6/1962 | Taylor |
| 3,350,871 | A | 11/1967 | Pierce et al. |
| 3,454,422 | A | 7/1969 | Mead et al. |
| 3,454,460 | A | 7/1969 | Bosley |
| 3,584,103 | A | 6/1971 | Harris |
| 3,671,379 | A | 6/1972 | Evans et al. |
| 3,681,188 | A | 8/1972 | Harris |
| 3,772,137 | A | 11/1973 | Tolliver |
| 3,816,486 | A | 6/1974 | Vail |
| 3,973,383 | A | 8/1976 | Yu |
| 3,998,042 | A | 12/1976 | Reese |
| 4,134,882 | A | 1/1979 | Frankfort et al. |
| 4,159,617 | A | 7/1979 | Allan |
| 4,256,589 | A | 3/1981 | Carver et al. |
| 4,639,347 | A | 1/1987 | Hancock et al. |
| 4,710,432 | A | 12/1987 | Nishimura et al. |
| 4,725,635 | A | 2/1988 | Okada et al. |
| 4,794,038 | A | 12/1988 | Marcus |
| 4,836,763 | A | 6/1989 | Broaddus |
| 4,850,847 | A | 7/1989 | Samuelson |
| 5,104,725 | A | 4/1992 | Broaddus |
| 5,112,684 | A | 5/1992 | Halm et al. |
| 5,458,971 | A | 10/1995 | Hernandez et al. |
| 5,527,600 | A | 6/1996 | Frankosky et al. |
| 5,645,782 | A | 7/1997 | Howell et al. |
| 5,683,811 | A | 11/1997 | Hernandez et al. |
| 5,723,215 | A | 3/1998 | Hernandez et al. |
| 5,736,243 | A | 4/1998 | Aneja et al. |
| 5,782,935 | A | 7/1998 | Hirt et al. |
| 5,851,665 | A | 12/1998 | Marcus |
| 5,874,372 | A | 2/1999 | Morishita et al. |
| 5,882,794 | A | 3/1999 | Hernandez et al. |
| 5,891,568 | A | 4/1999 | Hartzog et al. |
| 5,970,700 | A | 10/1999 | Scheerer et al. |
| 5,994,451 | A | 11/1999 | Dangayach |
| 6,023,926 | A | 2/2000 | Flynn |
| 6,037,057 | A | 3/2000 | Hartzog et al. |
| 6,250,060 | B1 | 6/2001 | Scheerer et al. |
| 6,287,688 | B1 | 9/2001 | Howell et al. |
| 6,306,498 | B1 | 10/2001 | Yuuki et al. |
| 2001/0030377 | A1 | 10/2001 | Howell et al. |
| 2001/0030378 | A1 | 10/2001 | Howell et al. |
| 2001/0031356 | A1 | 10/2001 | Howell et al. |

FOREIGN PATENT DOCUMENTS

| | | | |
|---|---|---|---|
| EP | 745 711 | A1 | 12/1996 |
| EP | 1 016 692 | A1 | 7/2000 |
| EP | 1 016 741 | A1 | 7/2000 |
| EP | 1 033 422 | A1 | 9/2000 |
| EP | 1 052 325 | A1 | 11/2000 |
| EP | 1 160 362 | A1 | 12/2001 |
| GB | 1 075 689 | | 7/1967 |
| GB | 1 165 312 | | 9/1969 |
| GB | 1 254 826 | | 11/1971 |
| JP | 52-5320 | | 1/1977 |
| JP | 58-076517 | A | 5/1983 |

(Continued)

OTHER PUBLICATIONS

"Textile Staple Production", Corterra Polymers, Shell Chemical Company (Copyright Shell 2000).

(Continued)

*Primary Examiner*—Leo B. Tentoni
(74) *Attorney, Agent, or Firm*—Mark D. Kuller

(57) ABSTRACT

The invention relates to webs or batts including polytrimethylene terephthalate crimped staple fibers and fiberfill products comprising such webs and batts, as well as the processes of making the staple fibers, webs, batts and fiberfill products. According to the preferred process of making a web or batt, polytrimethylene terephthalate staple fibers, containing polytrimethylene terephthalate is melt spun at a temperature of 245–285° C. into filaments. The filaments are quenched, drawn and mechanically crimped to a crimp level of 8–30 crimps per inch (3–12 crimps/cm). The crimped filaments are relaxed at a temperature of 50–130° C. and then cut into staple fibers having a length of about 0.2–6 inches (about 0.5–about 15 cm). A web is formed by garnetting or carding the staple fibers and is optionally cross-lapped to form a batt. A fiberfill product is prepared with the web or batt.

41 Claims, 4 Drawing Sheets

FOREIGN PATENT DOCUMENTS

| | | | |
|---|---|---|---|
| JP | 62-85026 | A | 4/1987 |
| JP | 02-61111 | A | 3/1990 |
| JP | 05-71013 | A | 3/1993 |
| JP | 9-111629 | A | 4/1997 |
| JP | 11-093034 | A | 4/1999 |
| JP | 11-100721 | A | 4/1999 |
| JP | 11-100768 | A | 4/1999 |
| JP | 11-107036 | A | 4/1999 |
| JP | 11-107038 | A | 4/1999 |
| JP | 11-107081 | A | 4/1999 |
| JP | 11-107149 | A | 4/1999 |
| JP | 11-158733 | A | 6/1999 |
| JP | 11-189920 | A | 7/1999 |
| JP | 11-189938 | A | 7/1999 |
| JP | 11-335954 | A | 12/1999 |
| JP | 00-017556A | A | 1/2000 |
| WO | WO 93-11292 | A1 | 6/1993 |
| WO | WO 99/28122 | A1 | 6/1999 |
| WO | WO 99/50483 | A1 | 10/1999 |
| WO | WO 00/03078 | A1 | 1/2000 |
| WO | WO 00/26301 | A1 | 5/2000 |
| WO | WO 01/07693 | A1 | 2/2001 |
| WO | WO 01-49909 | A1 | 7/2001 |
| WO | WO 01/66837 | A1 | 9/2001 |
| WO | WO 01/66838 | A1 | 9/2001 |
| WO | WO 01/68962 | A2 | 9/2001 |

OTHER PUBLICATIONS

Ch. Hwo et al., "Opportunities of Corterra PTT fibers in textiles", Reprinted from Chemical Fibers International, vol. 50 (2000) No. 1, Feb. 2000, referencing lecture held at the Polyester 999 World Congress, Oct. 25–28, 1999 in Zurich Switzerland.

H.S. Brown, et al., "Poly(Trimethylene Terephthalate) Polymers for Fibers", Shell Chemical Company (Copyright 1999).

M. Moeman, et al., Corterra Polymers, Value Proposition in Textile Apparel Applications, Shell Chemical Company (Copyright Shell 2001).

P. Casey et al., "Elastic PTT staple spun yams and fabrics", Research Disclosure 445034 (May 2001).

P. Casey et al., "Staple fibers made from low intrinsic viscosity polytrimethyleneterephthalate", Research Disclosure 445077 (May 2001).

H.L. Traub, et al., "Mechanical properties of fibers made of polytrimethylene terephthalate", Chemical Fibers International, vol. 45, pp. 110–111 (1995).

W. Oppermann, et al., "Fibers Made of Poly(trimethylene terephthalate)".

I. M. Ward, et al., "The Mechanical Properties and Structure of Poly(m–methylene Terephthalate) Fibers", Journal of Polymer Science vol. 14, 263–274 (1976).

H. L. Traub, "Synthese und textilchemische Eigenschaften des Poly–Trimethyleneterephthalats", Dissertation Universitat Stuttgart (1994), (Translation).

S. Schauhoff, "New Developments in the Production of Polytrimethylene Terephthalate (PTT)", Man–Made Fiber Year Book (Sep. 1996).

"Corterra® staple fibre for spinning", from Shell Chemical Compani for presentation at 39th International Man–made Fibre Congress, held Dornbirn, Austria (Sep. 13–15, 2000).

U.S. patent application No. 09/518,732, filed Mar. 3, 2000.

U.S. patent application No. 09/795,933, filed Feb. 28, 2001.

U.S. patent application No. 09/518,759, filed Mar. 3, 2000.

U.S. patent application No. 09/795,518, filed Feb. 28, 2001.

U.S. patent application No. 09/795,520, filed Feb. 28, 2001.

U.S. patent application No. 60/187,244, filed Mar. 3, 2000.

U.S. patent application No. 09/796,785, filed Mar. 1, 2001.

U.S. patent application No. 09/855,343, filed May 15, 2001.

Research Disclosure 17410 (Oct. 1978).

International Search Report from counterpart PCT/US01/26681 (Jan. 24, 2002.

U.S. patent application No. 09/934,904, filed Aug. 22, 2001.

U.S. patent application No. 09/934,866, filed Aug. 22, 2001.

C. C. Hwo, et al., Nonwovens from Poly(trimethylene terephthalate) Staple, Corterra Polymers, (Shell Chemicals 2000).

J. Bettner, et al., "High productivity staple fiber spinning technology", *Man Made Fibers Year Book* (Aug. 2001).

J. Bettner et al., Zimmer AG, "High Productivity of Staple Fiber Production", *The Polyester Chain 2001* (Zurich Dec. 23, 2001).

I. Cordes et al., "New Spinning System, Advanced Staple Line Concept Boost Throughput by 100%", *International Fibers Journal* (1998).

PROCESS OF MAKING WEB OR FIBERFILL FROM POLYTRIMETHYLENE TEREPHTHALATE STAPLE FIBERS

RELATED APPLICATIONS

This application claims priority from U.S. Provisional Patent Application Ser. No. 60/231,852, filed Sep. 12, 2000, which is incorporated herein by reference.

FIELD OF THE INVENTION

The invention relates to webs or batts comprising polytrimethylene terephthalate ("3GT") crimped staple fibers and fiberfill products comprising such webs and batts, as well as the processes of making the staple fibers, webs, batts and fiberfill products.

BACKGROUND OF THE INVENTION

Polyethylene terephthalate ("2GT") and polybutylene terephthalate ("4GT"), generally referred to as "polyalkylene terephthalates", are common commercial polyesters. Polyalkylene terephthalates have excellent physical and chemical properties, in particular chemical, heat and light stability, high melting points and high strength. As a result they have been widely used for resins, films and fibers, including staple fibers and fiberfill comprising such staple fibers.

Polytrimethylene terephthalate (3GT) has achieved growing commercial interest as a fiber because of the recent developments in lower cost routes to 1,3-propane diol (PDO), one of the polymer backbone monomer components. 3GT has long been desirable in fiber form for its disperse dyeability at atmospheric pressure, low bending modulus, elastic recovery and resilience. In many end-uses, such as fiberfill applications, staple fibers are preferred over continuous filament.

The manufacture of staple fiber suitable for fiberfill poses a number of potential advantages as well as some specific problems over prior staples used in fiberfill. The challenges lie in obtaining a balance of properties which includes obtaining satisfactory fiber crimp, and sufficient fiber toughness (breaking strength and abrasion resistance), while preserving the softness and low fiber-to-fiber friction. This balance of properties is essential to achieve both downstream processing such as carding or garnetting, while ultimately providing a desirable consumer product.

In the case of 2GT, which is a widely used staple fiber for fiberfill, these problems are being met by the fiber producers through improvements in polymerization chemistry and optimized fiber production. This has led to improved spinning and drawing processes tailored to the production of high performance 2GT fibers. There is a need for an improved 3GT staple fiber process which generates fibers with suitable processability in commercial mills employing carding and garnetting processes. The solutions to these problems developed over the years for 2GT or 4GT fibers frequently do not directly translate to 3GT fibers because of the unique properties inherent in the 3GT polymer chemistry.

Downstream processing of staple fibers into fiberfill end uses is typically done on conventional staple cards or garnets. The carded web or batt is typically cross-lapped to a desired basis weight and/or thickness, optionally bonded, and then directly inserted as the filling material in the desired end use. In the case of pillows for use in sleep comfort, the batt (which may be optionally bonded by incorporation of a resin or lower melting fiber and passage of the batt through a heated oven) is cut and filled into a pillow ticking at a typical loading of 12–24 ounces. As outlined above, this process includes several steps, many of which are done at high speeds and subject the fibers to a significant amount of abrasion, placing demands on the fiber tensile properties. For example, the initial step is fiber opening, which is often done by tumbling the fibers on motorized belts which contain rows of pointed steel teeth for the purposes of pulling and separating large group of fibers. The opened fibers are then conveyed via forced air and, typically, are then passed thorough networks of overhead ductwork or chute feeders. The chute feeders feed the card or garnett, devices which separate the fibers via the combing action of rolls containing a high density of teeth made of rigid wire.

The fibers must possess a critical set of physical properties such that they will pass through the above process with efficiency (minimal fiber damage and stoppages), while making a material suitable for use as a fiberfill. One of the most critical parameters is fiber strength, defined as the tenacity or grams of breaking strength per unit denier. In the case of 2GT, fiber tenacities of 4 to 7 grams per denier are obtainable over a wide range of fiber deniers. In the case of 3GT, typical tenacities are below 3 grams per denier. These fibers with only a few grams of breaking strength are not desirable for commercial processing. There is a need for 3GT staple fibers with tenacities over 3 grams per denier, especially for fibers on the lower denier end of the typical range for fiberfill staples (2.0–4.5 dpf). Additionally, Crimp take-up, a measure of the springiness of the fiber as imparted by the mechanical crimping process, is an important property for fiberfill staples, both for processing the staple fibers and for the properties of the resulting fiberfill product. Further fiber modifications typically include application of a coating to tailor the fiber surface properties to increase the loft or refluffability of the structure, as well as to reduce the fiber-to-fiber friction. These coatings are typically referred to as "slickeners". Such coatings allow easier motion amongst the fibers as described by U.S. Pat. Nos. 3,454,422 and 4,725,635. The coatings also increase the overall deflection of the assembly, since fibers would slide easier over each other.

Fiber crimp also influences the load bearing performance of the three dimensional structure. Fiber crimp, which may be two-dimensional or three dimensional, is conventionally produced via mechanical means or it may be inherent in the fiber due to structural or compositional differences. Assuming constant fiber weight, similar fiber size, geometry and surface properties, in general a lower crimp fiber (i.e., a high amplitude, low frequency crimp) will produce higher loft (i.e., a high effective bulk, low density three dimensional structure, which will deform easily under a given standard load due to low level of interlocking of the crimped fibers). In contrast, higher crimp fibers (low amplitude, high frequency) generally produce three dimensional structures with higher density and reduced loft. Such higher density three dimensional structures will not deform as readily when a standard load is applied, due to a higher level of fiber interlocking in the structure. In typical filled articles, the applied load (i.e., the load the article is designed to support) is high enough to cause relative displacement of fibers in the structure. However, this load is not high enough to cause plastic deformation of the individual fibers.

The crimp level also affects the fiber's ability to recover from compression. Low crimp level fibers do not recover as readily as high crimp fibers since low crimp fibers lack the "springiness" that higher crimp provides. On the other hand, low crimp fibers are easier to refluff due to the lower amount of fiber interlocking. As discussed above, the user of the filled article typically wants both support and loft. Both of these properties are greatly influenced by crimp frequency, but in opposite and conflicting ways. To get high loft, one uses low crimp. Conversely, to get high support, one uses high crimp. Additional variables one may modify include altering the mechanical properties of the fiber, adjusting the fiber denier, and/or manipulating the fiber cross-section.

For end use applications of fiberfill staple, the product must meet several criteria which are requisite to nearly all commercial applications. There is a need for high bulk, especially effective and resistive bulk. Effective bulk means the filling material fully and effectively fills the space in which it is placed. Materials having a high level of effective bulk are said to have good "filling power" because of their ability to provide a high crown or plump appearance to the filled article. Resistive bulk, also herein referred to as "support bulk," means the filling material resists deformation under an applied stress. Structures with resistive bulk filling will not have a pad-like feeling under load and will provide some measure of resilience support even under high stresses. Resistive bulk filling is desirable because filled articles provide both good support bulk and are highly insulative.

Resilience, i.e., recovery from tension or compression, is another important characteristic for filling material. Materials with high resilience are lively and exhibit a significant degree of recovery from tension or compression, while low resilience materials are less springy. Resilience and support are especially important for materials used in products such as pillows, which must yield to conform to the shapes of any objects applying compression and at the same time provide adequate support for the objects. Additionally, once the object is removed, the pillow must recover from the compression and be ready to conform and support subsequent objects placed thereon. Finally, as resilience increases, the commercial processability of fibers improves.

Traditionally, down filling material was used in products to provide cushioning and insulation in addition to softness to the touch desirable in many applications. However, major drawbacks to traditional filling material include its high cost and the allergens commonly found in the down material. Additionally, because down filling material is not waterproof, it absorbs water and becomes heavy and provides less cushioning support when exposed to wet environments.

The art of producing and perfecting synthetic fiberfill materials seeks to solve these and other problems. The ultimate goal in this area has been to produce synthetic fiberfill as resilient, comfortable and refluffable as down but at the same time, providing the two key advantages over down: a hypoallergenic and waterproof filling. A major advancement was introduction of synthetic fiberfill material made from polyesters. 2GT has long been used to produce fiberfill material having some of the qualities of down. Throughout the years, many researchers have sought to create polyester fiberfill material approaching down by emulating its form or finding ways to approximate its performance. Methods of creating new structures or fiber shapes are described in Marcus, U.S. Pat. Nos. 4,794,038 and 5,851,665, Broaddus, U.S. Pat. No. 4,836,763, and Samuelson, U.S. Pat. No. 4,850,847. However synthetic polyesters made from such polyesters have shortcomings in that 2GT polyester fibers are inherently rigid, and have high fiber-to-fiber friction. This latter property which even for fibers treated with a cureable silicone finish, causes the fibers to become matted and clumped together due to fiber entanglement and abrasion. Presumably these phenomena cause the slickener coating to be damaged or removed over the life of the fiberfill.

Fibers in fiberfill applications are combined to form three-dimensional ("3D") load-bearing structures. The load-deflection characteristics of such three dimensional structures are influenced by three key factors: the properties of the fiber making up the structure; the manufacturing technique used to make the three dimensional structure; and the enclosure surrounding the three dimensional structure. Moreover, studies have indicated that the deflection of such a structure is due to the displacement of individual fibers in the structure. Fiber displacement in such structures is dependent on the amount of crimp on each fiber (which affects the amount of interlocking), the mechanical properties (i.e., bending moment and Young's Modulus), the fiber's recovery properties (how easily the fibers can be deflected and how easily they recover from that deflection), the fiber's size and geometry, and the fiber-to-fiber friction properties of the fibers (how easily fibers slide over each other).

While commercial availability of 3GT is relatively new, research has been conducted for quite some time. For instance, U.S. Pat. No. 3,584,103 describes a process for melt spinning 3GT filaments having asymmetric birefringence. Helically crimped textile fibers of 3GT are prepared by melt spinning filaments to have asymmetric birefringence across their diameters, drawing the filaments to orient the molecules thereof, annealing the drawn filaments at 100–190° C. while held at constant length, and heating the annealed filaments in a relaxed condition above 45° C., preferably at about 140° C. for 2–10 minutes, to develop crimp. All of the examples demonstrate relaxing the fibers at 140° C.

JP 11-107081 describes relaxation of 3GT multifilament yarn unstretched fiber at a temperature below 150° C., preferably 110–150° C., for 0.2–0.8 seconds, preferably 0.3–0.6 seconds, followed by false twisting the multifilament yarn.

EP 1 016 741 describes using a phosphorus additive and certain 3GT polymer quality constraints for obtaining improved whiteness, melt stability and spinning stability. The filaments and short fibers prepared after spinning and drawing are heat treated at 90–200° C.

JP 11-189938 teaches making 3GT short fibers (3–200 mm), and describes a moist heat treatment step at 100–160° C. for 0.01 to 90 minutes or dry heat treatment step at 100–300° C. for 0.01 to 20 minutes. In Working Example 1, 3GT is spun at 260° C. with a yarn-spinning take-up speed of 1800 m/minute. After drawing the fiber is given a constant length heat treatment at 150° C. for 5 minutes with a liquid bath. Then, it is crimped and cut. Working Example 2 applies a dry heat treatment at 200° C. for 3 minutes to the drawn fibers.

British Patent Specification No. 1 254 826 describes polyalkylene filaments, staple fibers and yarns including 3GT filaments and staple fibers. The focus is on carpet pile and fiberfill. Example IV describes the use of the process of Example I to prepare 3GT continuous filaments. Example V describes use of the process of Example I to make 3GT staple fibers. Example I describes passing a filament bundle into a stuffer box crimper, heat setting the crimped product in tow form by subjecting it to temperatures of about 150° C. for a period of 18 minutes, and cutting the heat-set tow into 6 inch staple lengths. Example VII describes the testing of 3GT staple fiberfill batts comprising 3GT prepared according to the process of Example IV.

All of the documents described above are incorporated herein by reference in their entirety.

SUMMARY OF THE INVENTION

The invention is directed to a process of making a web or batt comprising polytrimethylene terephthalate staple fibers, comprising (a) providing polytrimethylene terephthalate, (b) melt spinning the melted polytrimethylene terephthalate at a temperature of 245–285° C. into filaments, (c) quenching the filaments, (d) drawing the quenched filaments, (e) crimping the drawn filaments using a mechanical crimper at a crimp level of 8–30 crimps per inch (3–12 crimps/cm), (f) relaxing the crimped filaments at a temperature of 50–130° C., (g) cutting the relaxed filaments into staple fibers having a length of about 0.2–6 inches (about 0.5-about 15 cm), (h) garnetting or carding the staple fibers to form a web and (i) optionally cross-lapping the web to form a batt.

The invention is also directed to a process of making a fiberfill product comprising polytrimethylene terephthalate staple fibers, comprising (a) providing polytrimethylene terephthalate, (b) melt spinning the melted polytrimethylene terephthalate at a temperature of 245–285° C. into filaments, (c) quenching the filaments, (d) drawing the quenched filaments, (e) crimping the drawn filaments using a mechanical crimper at a crimp level of 8–30 crimps per inch (3–12 crimps/cm), (f) relaxing the crimped filaments at a temperature of 50–130° C., (g) cutting the relaxed filaments into staple fibers having a length of about 0.2–6 inches (about 0.5-about 15 cm), (h) garnetting or carding the staple fibers to form a web, (i) optionally cross-lapping the web to form a batt, and (j) filling the web or batt into a fiberfill product.

The staple fibers preferably are 3–15 dpf, more preferably 3–9 dpf.

Preferably, the staple fibers have a length of about 0.5-about 3 inches (about 1.3-about 7.6 cm).

In a preferred embodiment, the cross-lapping is carried out.

In a preferred embodiment, the web is bonded together. Preferably, the bonding is selected from spray bonding, thermal bonding and ultrasonic bonding.

In a preferred embodiment, a low bonding temperature staple fiber is mixed with the staple fibers to enhance bonding.

In a preferred embodiment, fibers selected from the group consisting of cotton, polyethylene terephthalate, nylon, acrylate and polybutylene terephthalate fibers are mixed with the staple fibers.

Preferably, the relaxation is carried out by heating the crimped filaments in an unconstrained condition.

Preferably, the process is carried out without an anneal step.

The invention is also directed to a process of preparing a polytrimethylene terephthalate staple fiber having a desirable crimp take-up comprising (a) determining the relationship between denier and crimp take-up and (b) manufacturing staple fibers having a denier selected based upon that determination.

The invention is described in greater detail in the detailed description of the invention, the appended drawing and the attached claims.

DESCRIPTION OF THE DRAWINGS (FROM THE PROVISIONAL)

DETAILED DESCRIPTION OF THE INVENTION

Figure 1:
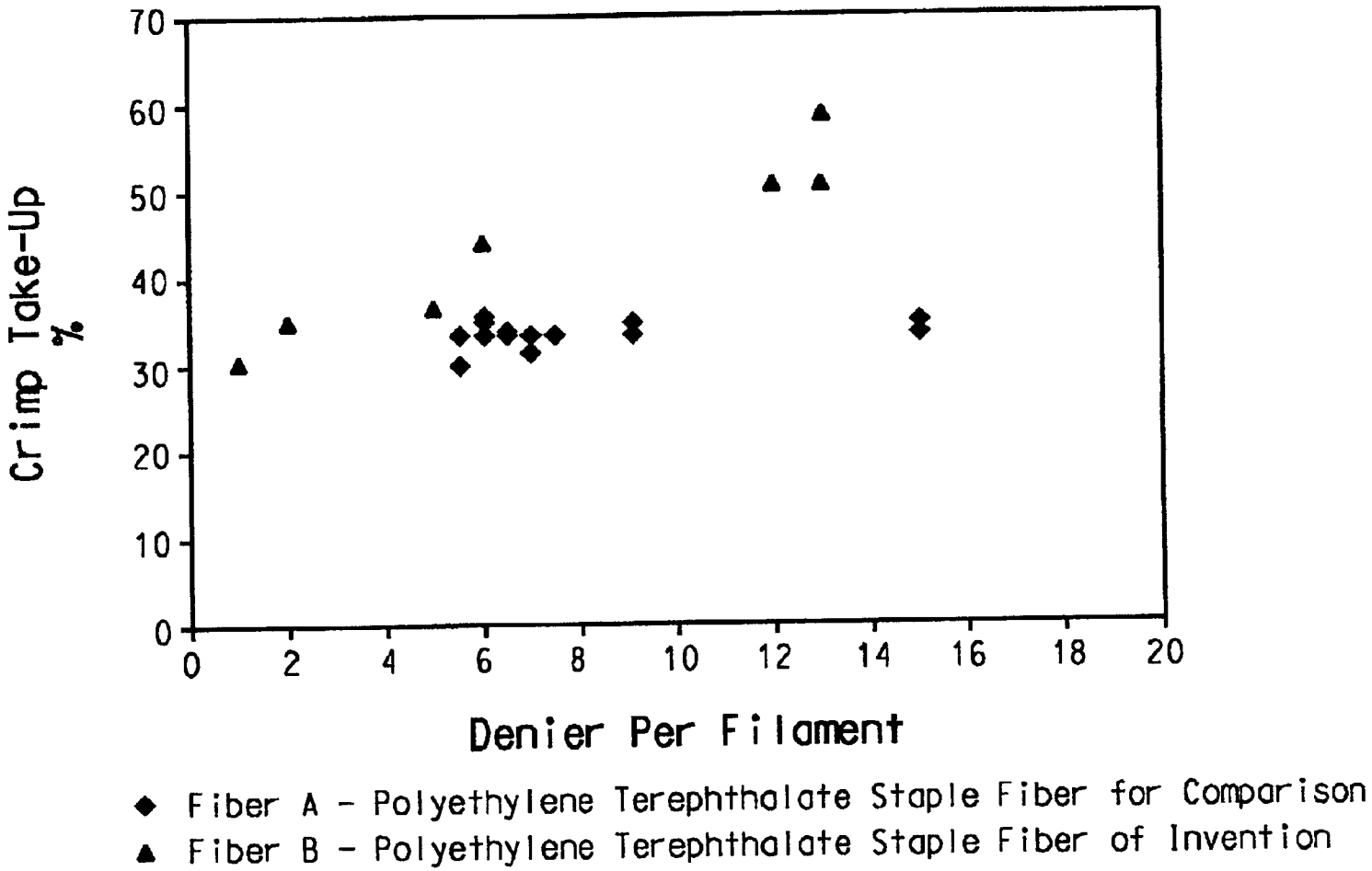
FIG. 1 is a scatter chart showing the relationship between crimp take-up and denier for fibers of the invention and further showing the absence of such relationship in fibers previously known in the art.

The invention is directed to a process for preparing drawn, crimped staple polytrimethylene terephthalate fibers suitable for fiberfill applications and the process of making fiberfill from the resultant fibers, as well as the resulting fibers, webs, batts and other products.

Polytrimethylene terephthalate useful in this invention may be produced by known manufacturing techniques (batch, continuous, etc.), such as described in U.S. Pat. Nos. 5,015,789, 5,276,201, 5,284,979, 5,334,778, 5,364,984, 5,364,987, 5,391,263, 5,434,239, 5,510,454, 5,504,122, 5,532,333, 5,532,404, 5,540,868, 5,633,018, 5,633,362, 5,677,415, 5,686,276, 5,710,315, 5,714,262, 5,730,913, 5,763,104, 5,774,074, 5,786,443, 5,811,496, 5,821,092, 5,830,982, 5,840,957, 5,856,423, 5,962,745, 5,990,265, 6,140,543, 6,245,844, 6,255,442, 6,277,289, 6,281,325 and 6,066,714, EP 998 440, WO 00/58393, 01/09073, 01/09069, 01/34693, 00/14041, 01/14450 and 98/57913, H. L. Traub, "Synthese und textilchemische Eigenschaften des Poly-Trimethyleneterephtbalats", Dissertation Universitat Stuttgart (1994), S. Schauhoff, "New Developments in the Production of Polytrimethylene Terephthalate (PTT)", Man-Made Fiber Year Book (September 1996), and U.S. patent application Ser. Nos. 09/501,700 (now U.S. Pat. No. 6,353,062 B1), 09/502,322 (now U.S. Pat. No. 6,312,805 B1), Ser. Nos. 09/502,642 and 09/503,599, all of which are incorporated herein by reference. Polytrimethylene terephthalates useful as the polyester of this invention are commercially available from E. I. du Pont de Nemours and Company, Wilmington, Del. under the trademark "Sorona".

The polytrimethylene terephthalate suitable for this invention has an intrinsic viscosity of at 0.60 deciliters/gram (dl/g) or higher, preferably at least 0.70 dl/g, more preferably at least 0.80 dl/g and most preferably at least 0.90 dl/g. The intrinsic viscosity is typically about 1.5 dl/g or less, preferably 1.4 dl/g or less, more preferably 1.2 dl/g or less, and most preferably 1.1 dl/g or less. Polytrimethylene terephthalate homopolymers particularly useful in practicing this invention have a melting point of approximately 225–231° C.

The staple fibers can be prepared by spinning polymer into filaments, optionally applying lubricant, drawing the filaments, crimping the filaments, applying slickener, relaxing the fibers (while curing the slickener), optionally applying an antistat to the filaments, cutting the filaments to form staple fibers, and baling the staple fibers.

Spinning can be carried out using conventional techniques and equipment described in the art with respect to polyester fibers, with preferred approaches described herein. For instance, various spinning methods are shown in U.S. Pat. Nos. 3,816,486 and 4,639,347, U.S. patent application Ser. No. 09/855,343, filed May 15, 2001, British Patent Specification No. 1 254 826 and JP 11-189938, all of which are incorporated herein by reference.

The spinning speed is preferably 600 meters per minute or more, and typically 2500 meters per minute or less. The spinning temperature is typically 245° C. or more and 285° C. or less, preferably 275° C. or less. Most preferably the spinning is carried out at about 255° C.

The spinneret is a conventional spinneret of the type used for conventional polyesters, and hole size, arrangement and number will depend on the desired fiber and spinning equipment.

Quenching can be carried out in a conventional manner, using air or other fluids described in the art (e.g., nitrogen). Cross-flow, radial, asymmetric or other quenching techniques may be used.

Conventional spin finishes can be applied after quenching via standard techniques (e.g., using a kiss role).

According to the preferred process, the melt-spun filaments are collected on a tow can and, then, several tow cans are placed together and a large tow is formed from the filaments. After this, the filaments are drawn using conventional techniques, preferably at about 50-about 120 yards/minute (about 46-about 110 m/minute). Draw ratios preferably range from about 1.25-about 4, more preferably from 1.25–2.5. Drawing can optionally be carried out using a two-stage draw process (see, e.g., U.S. Pat. No. 3,816,486, incorporated herein by reference). A finish can be applied during drawing using conventional techniques.

When preparing staple fibers for textile uses the fibers are preferably annealed after drawing and before crimping and relaxing. By "annealing" is meant that the drawn fibers are heated under tension, preferably at about 85° C.–about 115° C. for 3GT, as described in U.S. patent application Ser. No. 09/855,343, filed May 15, 2001, and in the range 140–200° C. for 2GT. This is typically done using heated rollers or saturated steam. The annealing process serves the function of building crystallinity with a preferential orientation along the fiber axis and by doing so increases fiber tenacity. Since for fiberfill applications, downstream processing is limited to carding and garnetting and does not place the fiber in harsh and abrasive yarn spinning processes, such an annealing step is typically not required for preparing staple fibers for fiberfill applications.

Conventional mechanical crimping techniques can be used. Preferred is a mechanical staple crimper with a steam assist, such as stuffer box.

A finish can be applied at the crimper using conventional techniques.

Crimp level is typically 8 crimps per inch (cpi) (3 crimps per cm (cpc)) or more, preferably 10 cpi (3.9 cpc) or more, and typically 30 cpi (11.8 cpc) or less, preferably 25 cpi (9.8 cpc) or less, and more preferably 20 cpi (7.9 cpc) or less. For fiberfill applications, crimp levels of about 10 cpi (3.9 cpc) are most preferred. The resulting crimp take-up (%) is a function of fiber properties and is preferably 10% or more, more preferably 15% or more, and even more preferably 20% or more, further more preferably 30% or more, and preferably is up to 40%, more preferably up to 60%.

A slickener is preferably applied after crimping, but before relaxing. Example slickeners useful in this invention are described by U.S. Pat. No. 4,725,635, which is incorporated herein by reference.

The inventors have found that lowering the temperature of the relaxation is critical for obtaining maximum crimp take-up. By "relaxation" is meant that the filaments are heated in an unconstrained condition so that the filaments are free to shrink. Relaxation is carried out after crimping and before cutting. Typically relaxation is carried out to take out shrinkage and dry the fibers. In a typical relaxer, fibers rest on a conveyor belt and pass through an oven. The minimum the temperature of the relaxation useful for this invention is 40° C., as lower temperatures will not permit the fiber to dry in a sufficient amount of time. Preferably the temperature of the relaxation is below 130° C., preferably 120° C. or less, more preferably 105° C. or less, even more preferably at 100° C. or less, still more preferably below 100° C., and most preferably below 80° C. Preferably the temperature of the relaxation is 55° C. or above, more preferably above 55° C., more preferably 60° C. or above, and most preferably above 60° C. Preferably the relaxation time does not exceed about 60 minutes, more preferably it is 25 minutes or less. The relaxation time must be long enough to dry the fibers and bring the fibers to the desired relaxation temperature, which is dependant on the size of the tow denier and can be seconds when small quantities (e.g., 1,000 denier (1,100 dtex)) are relaxed. In commercial settings, times can be as short as 1 minute. Preferably the filaments pass through the oven at a rate of 50–200 yards/minute (46-about 183 meters/minute) for 6–20 minutes or at other rates suitable to relax and dry the fibers. Preferably the slickener is cured during relaxing.

Optionally, an antistatic finish can be applied to the filaments after relaxing them.

Preferably the filaments are collected in a piddler can, followed by cutting, optional curing and baling. The staple fibers of this invention are preferably cut by a mechanical cutter following relaxation.

Preferably, the fibers are about 0.2-about 6 inches (about 0.5-about 15 cm), more preferably about 0.5-about 3 inches (about 1.3-about 7.6 cm), and most preferably about 1.5 inch (3.81 cm). Different staple length may be preferred for different end uses.

The fibers can be cured after cutting and before bailing. Curing methods and times will vary, and can be for seconds using UV means or longer using an oven. Oven temperatures are preferably about 80-about 100° C.

The staple fiber preferably has a tenacity of 3.0 grams/denier (g/d) (2.65 cN/dtex (Conversions to cN/dtex were carried out using 0.883 multiplied by g/d value, which is the industry standard technique.)) or higher, preferably greater than 3.0 g/d (2.65 cN/dtex), more preferably 3.1 g/d (2.74 cN/dtex) or higher, to enable processing on high-speed spinning and carding equipment without fiber damage. Tenacities of up to 4.6 g/d (4.1 cN/dtex) or higher can be prepared by the process of the invention. Most notably, these tenacities can be achieved with elongations (elongation to break) of 55% or less, and normally 20% or more.

Fiberfill utilizes about 0.8-about 40 dpf (about 0.88-about 44 dtex) staple fibers. The fibers prepared for fiberfill are typically at least 3 dpf (3.3 dtex), more preferably at least 6 dpf (6.6 dtex). They typically are 15 dpf (16.5 dtex) or less, more preferably 9 dpf (9.9 dtex) or less. For many applications, such as pillows, the staple fibers are preferably about 6 dpf (6.6 dtex).

The fibers preferably contain at least 85 weight %, more preferably 90 weight % and even more preferably at least 95 weight % polytrimethylene terephthalate polymer. The most preferred polymers contain substantially all polytrimethylene terephthalate polymer and the additives used in polytrimethylene terephthalate fibers. (Additives include antioxidants, stabilizers (e.g., UV stabilizers), delusterants (e.g., $TiO_2$, zinc sulfide or zinc oxide), pigments (e.g., $TiO_2$, etc.), flame retardants, antistats, dyes, fillers (such as calcium carbonate), antimicrobial agents, antistatic agents, optical brightners, extenders, processing aids and other compounds that enhance the manufacturing process or performance of polytrimethylene terephthalate.) When used, $TiO_2$ is preferably added in an amount of at least about 0.01 weight %, more preferably at least about 0.02 weight %, and preferably up to about 5% weight %, more preferably up to about 3 weight %, and most preferably up to about 2 weight %, by weight of the polymers or fibers. Dull polymers preferably contain about 2 weight % and semi-dull polymers preferably contain about 0.3 weight %.

The fibers of this invention are monocomponent fibers. (Thus, specifically excluded are bicomponent and multicomponent fibers, such as sheath core or side-by-side fibers made of two different types of polymers or two of the same polymer having different characteristics in each region, but does not exclude other polymers being dispersed in the fiber and additives being present.) They may be solid, hollow or multi-hollow. Round or other fibers (e.g., octalobal, sunburst (also known as sol), scalloped oval, trilobal, tetra-channel (also known as quatra-channel), scalloped ribbon, ribbon, starburst, etc.) can be prepared.

The staple fibers of this invention are intended for fiberfill applications. Preferably, the bales are opened, the fibers are combed—garnetted or carded—to form a web, the web is cross-lapped to form a batt (this enables achieving a higher weight and/or size), and the batts are filled into the final product using a pillow stuffer or other filler device. The fibers in the web can be further bonded together using common bonding techniques, such as spray (resin) bonding, thermal bonding (low-melt) and ultrasonic bonding. A low bonding temperature staple fiber (e.g., low bonding temperature polyester) is optionally mixed with the fibers to enhance bonding.

Webs produced with the claimed invention are typically about 0.5-about 2 ounces/yard$^2$ (about 17-about 68 g/m$^2$). Cross-lapped batts can comprise about 30-about 1,000 g/m$^2$ of fiber.

Using the invention, it is possible to prepare polytrimethylene terephthalate fiberfill having properties superior to 2GT staple fiberfill, including but not limited to increased fiber softness, crush resistance, self-bulking, and superior moisture transport properties. The invention is also directed to fiberfill comprising polytrimethylene terephthalate staple fibers and the process of making the fibers, and the process of making the fiberfill from the fibers.

Fiberfill prepared according to this invention can be used in many applications, including apparel (e.g., bra padding), pillows, furniture, insulation, comforters, filters, automotive (e.g., cushions), sleeping bags, mattress pads and mattresses.

The fibers of this invention preferably have a support bulk (BL2) of 0.2 or more and preferably of 0.4 inches or less. This is measured by performance in a batt.

EXAMPLES

The following examples are presented for the purpose of illustrating the invention, and are not intended to be limiting. All parts, percentages, etc., are by weight unless otherwise indicated.

Measurements and Units

Measurements discussed herein were made using conventional U.S. textile units, including denier, which is a metric unit. To meet prescriptive practices elsewhere, the U.S. units are reported herein, together with the corresponding metric units. Specific properties of the fibers were measured as described below.

Relative Viscosity

Relative Viscosity ("LRV") is the viscosity of polymer dissolved in HFIP solvent (hexafluoroisopropanol containing 100 ppm of 98% reagent grade sulfuric acid). The viscosity measuring apparatus is a capillary viscometer obtainable from a number of commercial vendors (Design Scientific, Cannon, etc.). The relative viscosity in centistokes is measured on a 4.75 weight % solution of polymer in HFIP at 25° C. as compared with the viscosity of pure HFIP at 25° C.

Intrinsic Viscosity

The intrinsic viscosity (IV) was determined using viscosity measured with a Viscotek Forced Flow Viscometer Y900 (Viscotek Corporation, Houston, Tex.) for the polyester dissolved in 50/50 weight % trifluoroacetic acid/methylene chloride at a 0.4 grams/dL concentration at 19° C. following an automated method based on ASTM D 5225-92.

Crimp Take-Up

One measure of a fiber's resilience is crimp take-up ("CTU") which measures how well the indicated frequency and amplitude of the secondary crimp is set in the fiber. Crimp take-up relates the length of the crimped fiber to the length of the extended fiber and thus it is influenced by crimp amplitude, crimp frequency, and the ability of the crimps to resist deformation. Crimp take-up is calculated from the formula:

$$CTU(\%)=[100(L_1-L_2)]/L_1$$

wherein $L_1$ represents the extended length (fibers hanging under an added load of 0.13±0.02 grams per denier (0.115±0.018 dN/tex) for a period of 30 seconds) and $L_2$ represents the crimped length (length of the same fibers hanging under no added weight after resting it for 60 seconds after the first extension).

Support Bulk

The bulk properties of batts of this invention are determined by compressing the filling structure on an Instron tester and determining the height under load. The test, hereinafter referred to as the total bulk range measurement ("TBRM") test, is carried out by cutting 6 inch (15.25 cm) squares from a carded web and adding them to a stack in a cross-lapped manner until their total weight is about 20 grams. The entire area is then compressed under a load of 50 pounds (22.7 kg). The stack height is recorded (after one conditioning cycle under a load of 2 pounds (0.9 kg)) for heights at loads of 0.01 ($H_i$) and 0.2 ($H_s$) pounds per square inch (0.0007 and 0.014 kg/cm$^2$, 68.95 and 1378.98 Pa) gauge. $H_i$ is the initial height and is a measure of effective bulk, i.e., the initial bulk or filling power, and $H_s$ is the height under load and is a measure of resistive bulk, i.e., the support bulk. As described in U.S. Pat. No. 5,723,215, with reference to U.S. Pat. Nos. 3,772, 137 and 5,458,971, all of which are incorporated by reference, BL1 and BL2 heights are measured in inches. BL1 at 0.001 psi (about 7 N/m$^2$), and BL2 at 0.2 psi (about 1400 N/m$^2$).

Friction

Friction is measured by the Staple Pad Friction ("SPF") method. A staple pad of the fibers whose friction is to be measured is sandwiched between a weight on top of the staple pad and a base that is underneath the staple pad and is mounted on the lower crosshead of an Instron 1122 machine (product of Instron Engineering Corp., Canton, Mass.).

The staple pad is prepared by carding the staple fibers (using a SACO-Lowell roller top card) to form a batt which is cut into sections, that are 4.0 inches (10.2 cm) in length and 2.5 inches (6.4 cm) wide, with the fibers oriented in the length dimension of the batt. Sufficient sections are stacked up so the staple pad weighs 1.5 g. The weight on top of the staple pad is 1.88 inches (4.78 cm) long, 1.52 inches (3.86 cm) wide, 1.46 inches (3.71 cm) high, and weighs 496 gm. The surfaces of the weight and of the base that contact the staple pad are covered with emery cloth (grit being in the 220 to 240 range), so that it is the emery cloth that makes contact with the surfaces of the staple pad. The staple pad is placed on the base. The weight is placed on the middle of the pad. A nylon monofilament line is attached to one of the smaller vertical (width×height) faces of the weight and passed around a small pulley up to the upper crosshead of the Instron, making a 90 degree wrap angle around the pulley.

A computer interfaced to the Instron is given a signal to start the test. The lower crosshead of the Instron is moved down at a speed of 12.5 in/minute (31.75 cm/minute). The staple pad, the weight and the pulley are also moved down with the base, which is mounted on the lower crosshead. Tension increases in the nylon line as it is stretched between the weight, which is moving down, and the upper crosshead, which remains stationary. Tension is applied to the weight in a horizontal direction, which is the direction of orientation of the fibers in the staple pad. Initially, there is little or no movement within the staple pad. The force applied to the upper crosshead of the Instron is monitored by a load cell and increases to a threshold level, when the fibers in the pad start moving past each other. (Because of the emery cloth at the interfaces with the staple pad, there is little relative motion at these interfaces; essentially any motion results from fibers within the staple pad moving past each other.) The threshold force level indicates what is required to overcome the fiber-to-fiber static friction and is recorded.

The coefficient of friction is determined by dividing the measured threshold force by the 496 gm weight. Eight values are used to compute the average SPF. These eight values are obtained by making four determinations on each of two staple pad samples.

Pillow Bulk

Pillow Bulk measurements differ from the Fiber Bulk measurements described earlier, as explained herein. Pillows are prepared from low density filling structures and subjected to tests for determination of their bulk properties. The pillows are prepared by producing a batt of a cross-lapped web. The batt is cut to suitable lengths for providing the desired weight and rolled and inserted into a cotton ticking measuring 20×26 inches (50.8×66.0 cm) when flat. The values for measurements on the filling structures reported in the examples are averaged values.

Pillows fabricated from filling material having the most effective bulk or filling power will have the greatest center height. The center height of the pillow under no load, $H_O$, is determined by mashing in the opposite corners of the pillow several times and placing the pillow on the load-sensitive table of an Instron tester and measuring its height at zero load. The Instron tester is equipped with a metal-disc presser foot that is 4 inches (10.2 cm) in diameter. The presser foot is then caused to apply a load of 10 pounds (4.54 kg) to the center section of the pillow and the height of the pillow at this point is recorded as the load height, $H_L$. Before the actual $H_O$ and $H_L$ measurements, the pillow is subjected to one cycle of 20 pounds (9.08 kg) compression and load release for conditioning. A load of 10 pounds (4.5 kg) is used for the $H_L$ measurement because it approximates the load applied to a pillow under conditions of actual use. Pillows having the highest $H_L$ values are the most resistive to deformation and thus provide the greatest support bulk.

Bulk durability is determined by submitting the filling structure to repeated cycles of compression and load release. Such repeated cycles, or workings, of the pillows are carried out by placing the pillow on a turntable associated with two pairs of 4×12 inch (10.2×30.5 cm) air powered worker feet which are mounted above the turntable in such a fashion that during one revolution essentially the entire contents are subjected to compression and release. Compression is accomplished by powering the worker feet with 80 pounds per square inch (552 kPa) gauge air pressure such that they exert a static load of approximately 125 pounds (56.6 kg) when in contact with the turntable. The turntable rotates at a speed of 1 revolution per 110 seconds and each of the worker feet compresses and releases the filling material 17 times per minute. After being repeatedly compressed for a specified period of time, the pillow is refluffed by mashing in the opposite corners several times. As before, the pillow is subjected to a conditioning cycle and the $H_O$ and $H_L$ values determined.

Comparative Example 1

This comparative example is based on processing polyethylene terephthalate ("2GT") using typical 2GT conditions. 2GT fibers, 6 denier per filament (6.6 dtex) round hollow fibers, were produced by melt extruding 21.6 LRV flake in a conventional manner at 297° C., through a 144-hole spinneret at about 16 pph (7 kg/h), with a spinning speed of about 748 ypm (684 mpm), applying a finish, and collecting yarns on tubes. The yarns collected on these tubes were combined into a tow and drawn at about 100 ypm (91 mpm) in a conventional manner using two-stage drawing (see, e.g., U.S. Pat. No. 3,816,486) in a mostly water bath (containing dilute finish). The first draw stage stretched the fiber about 1.5 times in a bath at 45° C. A subsequent draw of about 2.2 times was performed in a bath at 98° C. The fiber was then crimped in a conventional manner, using a conventional mechanical staple crimper, with steam assist. The fiber was crimped using two different crimp levels and two different steam levels. The fibers were then relaxed in a conventional manner at 180° C. The crimp take-up ("CTU") was measured after crimping and is listed below in Table 1.

TABLE 1

Effect of 180° C. Relaxation Temperature on 2GT

| Crimp Level, Cpi (c/cm) | Steam Pressure, psi (kPa) | Relaxation Temp., ° C. | Crimp Take-Up, % |
|---|---|---|---|
| 6 (2) | 15 (103) | 180 | 48 |
| 10 (4) | 15 (103) | 180 | 36 |
| 6 (2) | 50 (345) | 180 | 38 |
| 10 (4) | 50 (345) | 180 | 48 |

Example 1

Control-High Temperature Relaxer Conditions

This example illustrates that when staple fibers are prepared using high relaxation temperatures, staple fibers made from 3GT have significantly poorer quality than 2GT staple fibers. 3GT, 6 denier per filament (6.6 dtex) round hollow fibers, were produced using the same processing conditions as the Comparative Example except that, due to the difference in melting point versus 2GT, the 3GT fibers were extruded at 265° C. The first draw stage stretched the fiber about 1.2 times. The crimp take-up for the 3GT fibers was measured after crimping and is listed below in Table 2.

TABLE 2

Effect of 180° C. Relaxation Temperature on 3GT

| Crimp Level, Cpi (c/cm) | Steam Pressure, Psi (kPa) | Relaxation Temp., ° C. | Crimp Take-Up, % |
|---|---|---|---|
| 6 (2) | 15 (103) | 180 | 13 |
| 10 (4) | 15 (103) | 180 | 11 |
| 6 (2) | 50 (345) | 180 | 13 |
| 10 (4) | 50 (345) | 180 | 14 |

Comparing the results shown in Tables 1 and 2, it is readily observed that, under similar staple processing conditions, the 3GT fibers made with the high relaxation temperatures have much lower crimp retention which will result in a reduced support bulk. Additionally the 3GT fibers have reduced mechanical strength. These properties are essential for fiberfill applications, making the above 3GT results generally marginal or unsatisfactory.

Comparative Example 2

This comparative example is based on processing 2GT using the inventive processing conditions for 3GT.

In this example, 2GT fibers of about 6 denier per filament (6.6 dtex) were spun in a conventional manner at about 92 pph (42 kg/h), at 280° C., using a 363-hole spinneret and about 900 ypm (823 mpm) spinning speed and collected on tubes. The yarns collected on these tubes were combined into a tow and drawn at about 100 ypm (91 mpm) in a conventional manner using two-stage drawing in a mostly water bath. The first draw stage stretched the fiber about 3.6 times in a bath at 40° C. A subsequent draw of about 1.1 times was performed in a bath at 75° C. The fiber was then crimped in a conventional manner, using a conventional mechanical staple crimper, with steam assist. The fiber was crimped to about 12 cpi (5 c/cm), using about 15 psi (103 kPa) of steam. The fibers were then relaxed in a conventional manner at several temperatures. Crimp take-up, measured after crimping, is shown in Table 3.

TABLE 3

Effect of Lower Relaxation Temperatures on 2GT at 12 cpi (5 c/cm)

| Steam Pressure, psi (kPa) | Relaxation Temp., ° C. | Crimp Take-Up, % |
|---|---|---|
| 15 (103) | 100 | 32 |
| 15 (103) | 130 | 32 |
| 15 (103) | 150 | 29 |
| 15 (103) | 180 | 28 |

The 2GT shows only a slight decrease in recovery as measured by crimp take-up with increased relaxation temperature.

Example 2

In this example, 3GT fibers, 4.0 denier per filament (4.4 dtex) round fibers, were produced by melt extruding flake in a conventional manner at 265° C., through a 144-hole spinneret at about 14 pph (6 kg/h), with a spinning speed of about 550 ypm (503 mpm), applying a finish and collecting the yarns on tubes. These yarns were combined into a tow and drawn at about 100 ypm (91 mpm) in a conventional manner using two-stage drawing in a mostly water bath. The first draw stage stretched the fiber about 3.6 times in a mostly water bath at 45° C. A subsequent draw of about 1.1 times was performed in a bath at either 75° C. or 98° C. The fibers were then crimped in a conventional manner, using a conventional mechanical staple crimper, with steam assist. The fibers were crimped to about 12 cpi (5 c/cm) using about 15 psi (103 kPa) of steam. The fibers were then relaxed in a conventional manner at several temperatures. The crimp take-up was measured after crimping and is listed below in Table 4.

TABLE 4

Effect of Lower Relaxation Temperatures on 3GT at 12 cpi (5 c/cm)

| Bath Temp., ° C. | Steam Pressure, psi (kPa) | Relaxation Temp., ° C. | Crimp Take-Up, % |
|---|---|---|---|
| 75 | 15 (103) | 100 | 35 |
| 75 | 15 (103) | 130 | 24 |
| 75 | 15 (103) | 150 | 14 |
| 75 | 15 (103) | 180 | 11 |
| 98 | 15 (103) | 100 | 35 |
| 98 | 15 (103) | 130 | 17 |
| 98 | 15 (103) | 150 | 11 |
| 98 | 15 (103) | 180 | 9 |

The recovery properties of 3GT, as measured by crimp take-up and illustrated in Table 4, rapidly decreases with increased relaxation temperature. This behavior is surprisingly different from the behavior of 2GT, which as shown in Table 3, experiences only slight decrease in recovery with increased relaxation temperature. This surprising result was duplicated even when using a bath temperature of 98° C. for the second drawing stage, as shown in Table 4. This example also shows that 3GT fibers made according to the more preferred relaxation temperatures of this invention have superior properties over 2GT fibers.

Example 3

This example demonstrates another surprising correlation found with the 3GT fibers of the invention: varying the denier of the filaments. 3GT fibers of different denier and cross sections were made in a manner similar to the previous example. The recovery of the fibers, i.e., crimp take-up, was measured with the results listed in Table 5 below. The fibers were treated with a silicone slickener, such as described in U.S. Pat. No. 4,725,635, which is incorporated herein by reference, which cures at 170° C. when held for at least 4 minutes once the moisture has been driven from the tow. At 170° C. the crimp take-up of the fiber is very low. To produce slick fibers, the staple was held at 100° C. for 8 hours to cure the silicone slickener finish.

TABLE 5

Effect of Filament Denier on 3GT

| Filament Denier (dtex) | Fiber Cross-Section | Crimp Take-Up, % |
|---|---|---|
| 13.0 (14.4) | Round 1-void | 50 |
| 13.0 (14.4) | Triangular | 58 |
| 12.0 (13.3) | Triangular 3-void | 50 |

TABLE 5-continued

Effect of Filament Denier on 3GT

| Filament Denier (dtex) | Fiber Cross-Section | Crimp Take-Up, % |
|---|---|---|
| 6.0 (6.7) | Round 1-void | 44 |
| 4.7 (5.2) | Round Solid | 36 |
| 1.0 (1.1) | Round Solid | 30 |

As shown in Table 5, the denier of the filaments has a direct impact on the recovery from compression. As denier increases, the recovery, i.e., crimp take-up, increases with it. Similar testing with 2GT showed little impact on recovery with changes in denier. This unexpected result is better illustrated in FIG. 1. FIG. 1 plots crimp take-up versus denier per filament for three different types of fibers. Fiber B is fiber made according to the invention as detailed in Table 5. As can be seen in FIG. 1, with the 2GT fibers there is little or no change in recovery as denier per filament increases. On the other hand, with the 3GT fibers of the invention, there is a linear increase in recovery as denier per filament increases.

Example 4

This example demonstrates the preferred embodiment of the invention for a mid-denier round cross section staple fiber prepared under a series of processing conditions.

Polytrimethylene terephthalate of intrinsic viscosity (IV) 1.04 was dried over an inert gas heated to 175° C. and then melt spun into an undrawn staple tow through 741 hole spinnerettes designed to impart a round cross section. The spin block and transfer line temperatures were maintained at 254° C. At the exit of the spinnerette, the threadline was quenched via conventional cross flow air. A spin finish was applied to the quenched tow and it was wound up at 1400 yards/min (1280 meters/min). The undrawn tow collected at this stage was determined to be 5.42 dpf (5.96 dtex) with a 238% elongation to break and having a tenacity of 1.93 g/denier (1.7 cN/dtex). The tow product described above was drawn, crimped, and relaxed as described below.

Example 4A

The tow was processed using a two-stage draw-relax procedure. The tow product was drawn via a two-stage draw process with the total draw ratio between the first and the last rolls set to 2.10. In this two stage process, between 80–90% of the total draw was done at room temperature in the first stage, and then the remaining 10–20% of the draw was done while the fiber was immersed in atmospheric steam set to 90–100° C. The tension of the tow line was continually maintained as the tow was fed into a conventional stuffer box crimper. Atmospheric steam was also applied to the tow band during the crimping process. After crimping, the tow band was relaxed in a conveyer oven heated to 56° C. with a residence time in the oven of 6 minutes. The resulting tow was cut to a staple fiber which had a dpf of 3.17 (3.49 dtex). While the draw ratio was set to 2.10 as described above, the reduction in denier from undrawn tow (5.42 dpf) to final staple form (3.17 dpf) suggests a true process draw ratio of 1.71. The difference is caused by shrinkage and relaxation of the fiber during the crimping and relaxer steps. The elongation to break of the staple material was 87% and the fiber tenacity was 3.22 g/denier (2.84 cN/dtex). The crimp take-up of the fiber was 32% with a crimp/inch of 10 (3.9 crimp/cm).

Example 4B

The tow was processed using a single stage draw-relax procedure. The tow product was processed similar to Example 4A with the following modifications. The draw process was done in a single stage while the fiber was immersed in atmospheric steam at 90–100° C. The resulting staple fiber was determined to be 3.21 dpf (3.53 dtex), with an elongation to break of 88%, and the fiber tenacity was 3.03 g/denier (2.7 cN/dtex). The crimp take-up of the fiber was 32% with a crimp/inch of 10 (3.9 crimp/cm).

Example 4C

The tow was processed using a two-stage draw-anneal-relax procedure. The tow product was draw processed similar to Example 4A with the exception that in the second stage of the draw process the atmospheric steam replaced by a water spray heated to 65° C., and the tow was annealed under tension at 110° C. over a series of heated rolls before entering the crimping stage. The relaxer oven was set to 55° C. The resulting staple fiber was determined to be 3.28 dpf (3.61 dtex), with an elongation to break of 86%, and the fiber tenacity was 3.10 g/denier (2.74 cN/dtex). The crimp take-up of the fiber was 32% with a crimp/inch of 10 (3.9 crimp/cm).

Example 4D

This tow was processed using a two-stage draw-anneal-relax procedure. The tow product was draw processed similar to Example 4C. with the following modifications. The total draw ratio was set to 2.52. The annealing temperature was set to 95° C. and the relaxer oven was set to 65° C. The resulting staple fiber was determined to be 2.62 dpf (2.88 dtex), with an elongation to break of 67%, and the fiber tenacity was 3.90 g/denier (3.44 cN/dtex). The crimp take-up of the fiber was 31% with 13 crimp/inch (5.1 crimp/cm).

Example 5

This example illustrates the superior properties of fiberfill material of the invention. Round 1-void fibers were made using 3GT polymer, in a manner similar to Example 2, and crimped via a stuffer box mechanical crimper. The fibers were provided with a silicone coating of about 0.30% by weight of fiber to enhance the aesthetics in a garnetted batt. The silicone coating was cured as in Example 3. The batts were analyzed for resistive bulk, as a measure of load deflection or softness, i.e., $H_s$ as described above. Other measured properties include staple pad friction index (SPF), as a measure of frictional properties or silkiness, and crimp take-up (CTU), as a measure of compression recovery behavior. The results of the analyses are reported in Table 6.

TABLE 6

Fiberfill Properties of 3GT

| Fiber Cross-Section | $H_S$, in. (cm) | SPF, % | CTU, % |
|---|---|---|---|
| 5.3 dpf–1-void | 0.25 (0.64) | 0.203 | 38 |
| 5.0 dpf–1-void | 0.31 (0.79) | 0.255 | 40 |

Figure 2:
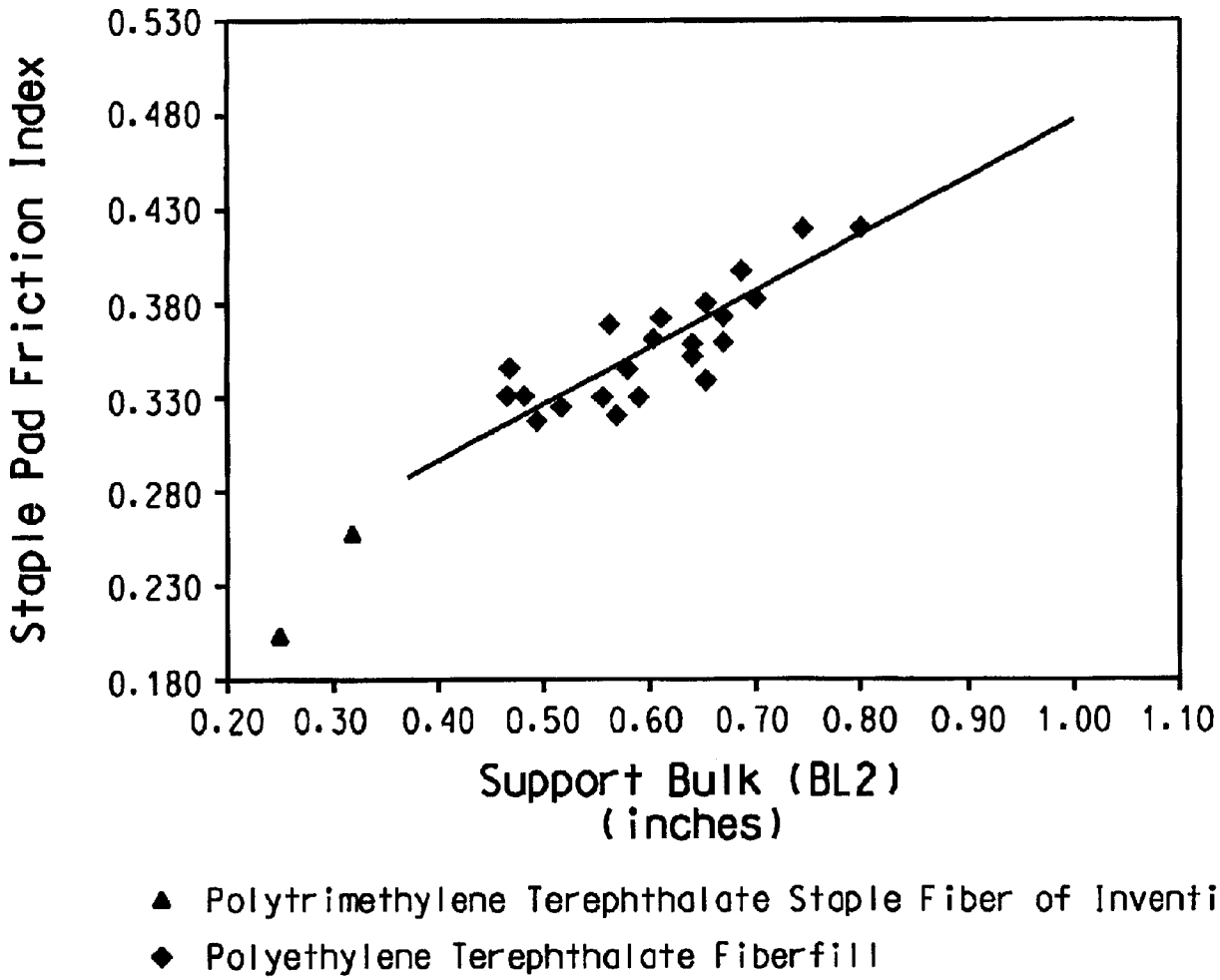
FIG. 2 is a scatter chart plotting support bulk versus the staple pad friction index for the fibers of the invention and commercial 2GT fiberfill.
Figure 3:
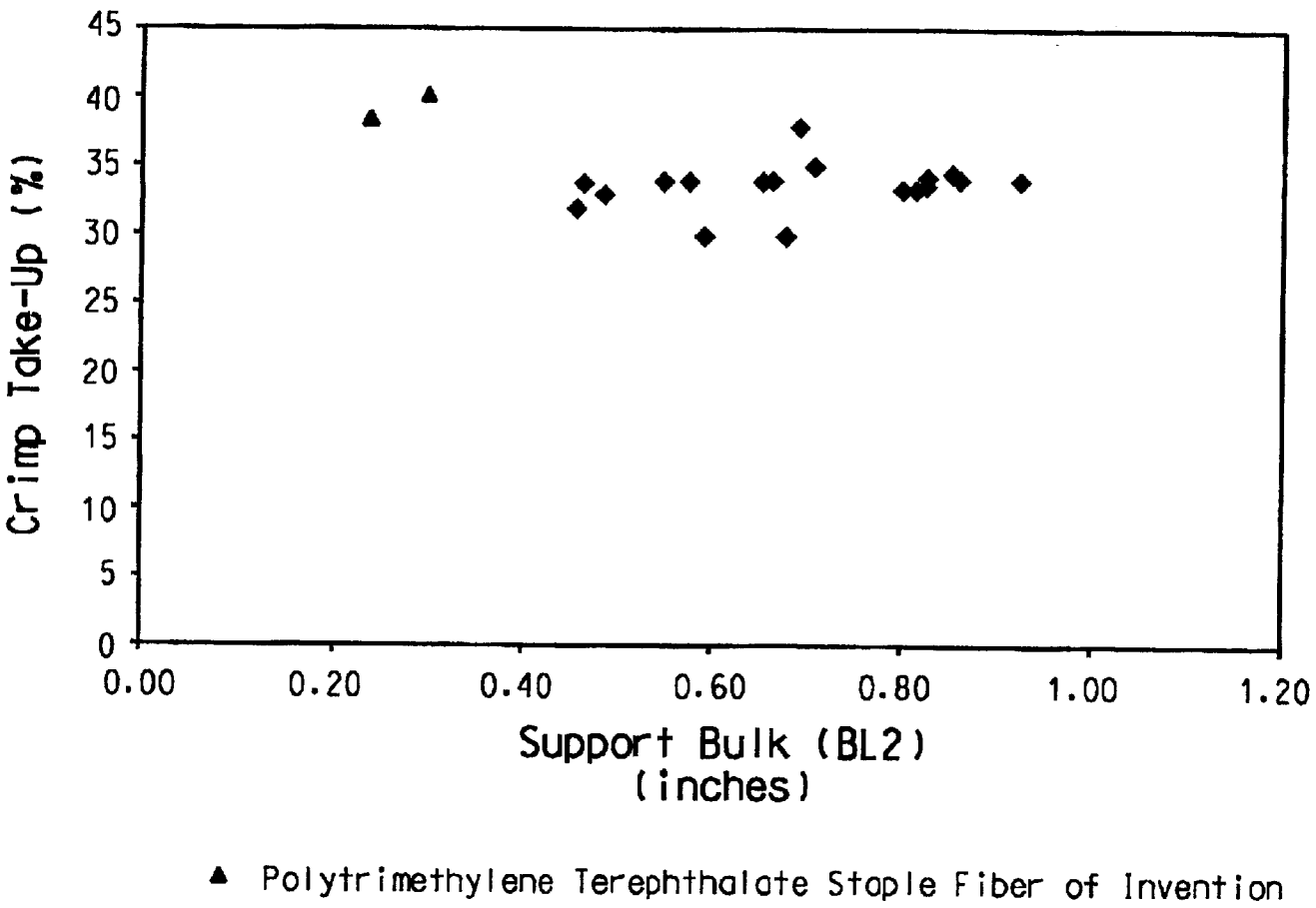
FIG. 3 is a scatter chart plotting support bulk versus crimp take-up for the fibers of the invention and commercial 2GT fiberfill.

Commercially available 2GT fibers were similarly provided with a conventional silicone coating. The load deflection and friction properties of the fibers of the invention were then compared to the commercial fibers. It was found that the 3GT fibers were much softer (i.e., lower load deflection) and silkier (i.e., lower friction index) than comparable 2GT fibers made using similar technology. FIG. 2 is a plot showing the friction index versus load deflection for the fibers of the invention along with commercially available fibers. FIG. 3 is a plot showing the recovery properties versus load deflection for the fibers shown in FIG. 2.

FIGS. 2 and 3, together, illustrate the advantage of the 3GT fibers of the invention over conventional 2GT fibers. Of key importance is the fact that while the 3GT fibers have lower friction and support, they still retain high levels of recovery. More specifically, note that the support and friction properties of the 3GT fibers are much lower than commercial 2GT offerings. (See FIG. 2.) However, the recovery of the 3GT fibers is as high or higher than for the 2GT fibers. (See FIG. 3.)

One of the key reasons for the absence of 2GT fibers in the low support and low friction region is that such fibers also had low crimp take-up. Traditionally, such fibers could not be commercially processed into end-use items using conventional fiberfill processing equipment. Commonly used conventional fiberfill processing equipment includes garnetting machines used to make batts used for stuffing in end-use products, and card machines typically used to process textile staple into sliver. Such conventional fiberfill equipment orient the staple fibers and generate a three-dimensional structure. As is known in the art, such machines rely on a certain "springiness" in the fibers to operate properly. Stated another way, if the crimp take-up is too low, the first cylinder would get clogged, stopping production.

Unlike prior synthetic fibers, the 3GT fibers of the invention have combined both good softness and low friction with high recovery. This combination of properties results in commercially acceptable processing using conventional fiberfill equipment. Further, the end-use products have superior properties over products made with 2GT, as shown in the next example.

Example 6

Figure 4:
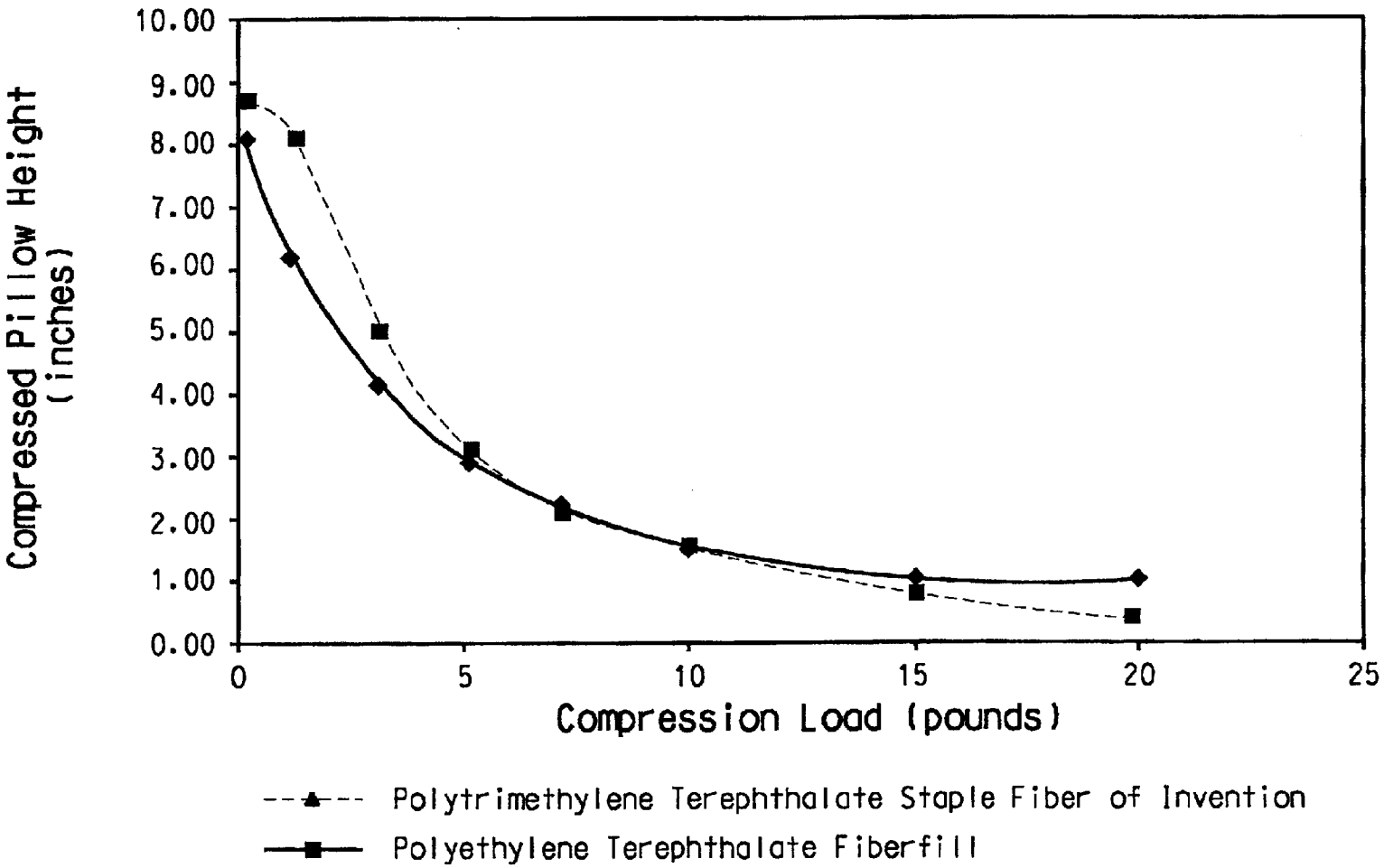
FIG. 4 is a graph showing compression curves for fibers of the invention and commercial 2GT fiberfill.

3GT staple fibers were garnetted and lapped into batts and the batts were then stuffed into pillows. One pillow was stuffed with the new fibers of the invention, while the other was stuffed with conventional 2GT fibers. The pillows were compressed to test the support properties of the fibers in an end-use application. The compression curves plotting the compression force versus the compression depth are shown in FIG. 4. The compression curves illustrate that the pillows made with the new fibers, i.e., 3GT, compressed easier than standard pillows up to a compression load of 10 pounds. This compression performance is perceived as a softer pillow by the user of the pillow. On the other hand, after 10 pounds of compression load, the 3GT pillows still retain some of their support properties avoiding the bottoming down of the pillow, as the commercial pillow does, which translates into a more comfortable pillow for the user.

The foregoing disclosure of embodiments of the invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

We claim:

1. A process of making a web or batt comprising polytrimethylene terephthalate staple fibers, comprising (a) providing polytrimethylene terephthalate, (b) melt spinning the melted polytrimethylene terephthalate at a temperature of 245–285° C. into filaments, (c) quenching the filaments, (d) drawing the quenched filaments, (e) crimping the drawn filaments using a mechanical crimper at a crimp level of 8–30 crimps per inch, (f) relaxing the crimped filaments at a temperature of 50–130° C., (g) cutting the relaxed filaments into staple fibers having a length of about 0.2–6 inches, (h) garnetting or carding the staple fibers to form a web and (i) optionally cross-lapping the web to form a batt.

2. The process of claim 1 wherein the staple fibers have a denier of3 to 15.

3. The process of claim 2 wherein the staple fibers have a length of about 0.5–about 3 inches.

4. The process of claim 1 wherein the staple fibers have a crimp take-up of 30% or more.

5. The process of claim 3 wherein the staple fibers have a crimp take-up of 30% or more.

6. The process of claim 1 wherein the relaxation is at 105° C. or less.

7. The process of claim 1 further comprising bonding the web.

8. The process of claim 7 wherein the bonding is selected from the group consisting of spray bonding, thermal bonding and ultrasonic bonding.

9. The process of claim 8 wherein a low bonding temperature staple fiber is mixed with the staple fibers to enhance bonding.

10. The process of claim 1 wherein fibers selected from the group consisting of cotton, polyethylene terephthalate, nylon, acrylate and polybutylene terephthalate fibers are mixed with the staple fibers.

11. The process of claim 1 wherein the relaxation is carried out by heating the crimped filaments in an unconstrained condition.

12. The process of claim 2 wherein the staple fibers are 3–9 denier per filament.

13. The process of claim 1 which is carried out without an anneal step after drawing and before crimping and relaxing.

14. A process of making a fiberfill product comprising polytrimethylene terephthalate staple fibers, comprising (a) providing polytrimethylene terephthalate, (b) melt spinning the melted polytrimethylene terephthalate at a temperature of 245–285° C. into filaments, (c) quenching the filaments, (d) drawing the quenched filaments, (e) crimping the drawn filaments using a mechanical crimper at a crimp level of 8–30 crimps per inch, (f) relaxing the crimped filaments at a temperature of 50–130° C., (g) cutting the relaxed filaments into staple fibers having a length of about 0.2–6 inches, (h) garnetting or carding the staple fibers to form a web, (i) optionally cross-lapping the web to form a batt, and (j) filling the web or batt into a fiberfill product.

15. The process of claim 14 wherein the staple fibers have a denier of 3 to 15 and a length of about 0.5–about 3 inches.

16. The process of claim 14 wherein the cross-lapping is carried out.

17. The process of claim 16 further comprising bonding the web.

18. The process of claim 14 wherein the relaxation is at 105° C. or less.

19. The process of claim 14 wherein fibers selected from the group consisting of cotton, polyethylene terephthalate, nylon, acrylate and polybutylene terephthalate fibers are mixed with the staple fibers.

20. The process of claim 1 wherein the relaxation is at less than 100° C.

21. The process of claim 20 wherein the relaxation is at less than 80° C.

22. The process of claim 20 wherein the relaxation is at 60° C. or above and the relaxation comprises passing the filaments through an oven at a rate of 50–200 yards/minute for 6–20 minutes.

23. The process of claim 20 which is carried out without an anneal step after drawing and before crimping and relaxing.

24. The process of claim 1 wherein the drawing is carried out using two-stage drawing.

25. The process of claim 24 wherein the two stage drawing comprises (a) a first stage drawing at room temperature and (b) the remaining drawing with the fiber immersed in atmospheric steam set to 90–100° C.

26. The process of claim 25 wherein 80–90% of the total draw is done in the first stage and 10–20% of the drawing is done in the remaining drawing.

27. The process of claim 25 wherein the two stage drawing comprises (a) a first stage drawing at room temperature and (b) the remaining drawing with the fiber immersed in a heated water spray.

28. The process of claim 25 wherein the two stage drawing comprises (a) a first stage drawing at room temperature and (b) the remaining drawing with the fiber immersed in a heated water spray.

29. The process of claim 1 wherein the drawing is carried out using single-stage drawing.

30. The process of claim 29 wherein tension and a water spray are applied to the drawn filament after drawing.

31. The process of claim 24 wherein the drawing is carried out using a draw ratio of about 1.25–about 4.

32. The process of claim 28 wherein the drawing is carried out using a draw ratio of about 1.25–about 4.

33. The process of claim 28 wherein the relaxation is at less than 100° C.

34. The process of claim 33 which is carried out without an anneal step after drawing and before crimping and relaxing.

35. The process of claim 14 wherein the relaxation is at 60° C. to less than 100° C. and the relaxation comprises passing the filaments through an oven at a rate of 50–200 yards/minute for 6–20 minutes.

36. The process of claim 14 wherein the relaxation is at less than 80° C.

37. The process of claim 14 which is carried out without an anneal step after drawing and before crimping and relaxing.

38. The process of claim 36 which is carried out without an anneal step after drawing and before crimping relaxing.

39. The process of claim 38 wherein the drawing is carried out using two-stage drawing comprising (a) a first stage drawing at room temperature and (b) the remaining drawing with the fiber immersed in atmospheric steam set to 90–100° C.; wherein 80–90% of the total draw is done in the first stage and 10–20% of the drawing is done in the remaining drawing; wherein the drawing is carried out using a draw ratio of about 1.25–about 4; wherein the relaxation is at 60° C. or above and comprises passing the filaments through an oven at a rate of 50–200 yards/minute for 6–20 minutes.

40. The process of claim 38 wherein the drawing is carried out using two-stage drawing comprising (a) a first stage drawing at room temperature and (b) the remaining drawing with the fiber immersed in a heated water spray, and wherein the drawing is carried out using a draw ratio of about 1.25–about 4.

41. The process of claim 38 wherein the drawing is carried out using single-stage drawing, wherein tension and a water spray are applied to the drawn filament after drawing, and wherein the drawing is carried out using a draw ratio of about 1.25–about 4.

* * * * *